US008928687B2

(12) United States Patent
Kang

(10) Patent No.: US 8,928,687 B2
(45) Date of Patent: Jan. 6, 2015

(54) METHOD AND APPARATUS FOR RGB COLOR SPACE GAMUT CONVERSION, AND LIQUID CRYSTAL DISPLAY DEVICE

(75) Inventor: Chih-tsung Kang, Guandong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 229 days.

(21) Appl. No.: 13/510,344

(22) PCT Filed: Mar. 29, 2012

(86) PCT No.: PCT/CN2012/073218
§ 371 (c)(1), (2), (4) Date: May 17, 2012

(87) PCT Pub. No.: WO2013/131294
PCT Pub. Date: Sep. 12, 2013

(65) Prior Publication Data

US 2013/0235064 A1 Sep. 12, 2013

(30) Foreign Application Priority Data

Mar. 8, 2012 (CN) ..... 2012 1 0059409

(51) Int. Cl.
*G09G 5/02* (2006.01)
*G09G 3/36* (2006.01)

(52) U.S. Cl.
USPC ..... 345/591

(58) Field of Classification Search
CPC ..... G09G 5/02; G09G 3/36
See application file for complete search history.

(56) References Cited

U.S. PATENT DOCUMENTS

2003/0090726 A1* 5/2003 Arai ..... 358/2.1
2010/0091034 A1* 4/2010 Matsumoto et al. ..... 345/601

OTHER PUBLICATIONS

Katsuhiro Kanamori et al, Fast color processor with programmable interpolation by small memory (PRISM), Jul. 1993, Journal of Electronic Imaging, vol. 2(3).*
Dongil Han, Real-Time Color Gamut Mapping Method for Digital TV Display Quality Enhancement, 2004, IEEE.*

* cited by examiner

*Primary Examiner* — Kee M Tung
*Assistant Examiner* — Xin Sheng
(74) *Attorney, Agent, or Firm* — Andrew C. Cheng

(57) ABSTRACT

The present invention discloses a method for RGB color space gamut conversion, including: projecting any point o in RGB color space having source graphic data onto points N, M; projecting point o' corresponding to point o onto points N', M'; based on matrix equations between point N and point N', and between point M and point M', computing point N' and point M'; based on points N', M', computing point o' in target cube corresponding to point o in RGB color space having source graphic data; and computing target color after color conversion from any point in source graphic data. The invention also discloses an apparatus for RGB color space gamut conversion and a liquid crystal display device. With this, it is possible to perform color conversion in RGB color space, adjust color performance of output in hue and color purity, and accentuate specific color.

5 Claims, 5 Drawing Sheets

METHOD AND APPARATUS FOR RGB COLOR SPACE GAMUT CONVERSION, AND LIQUID CRYSTAL DISPLAY DEVICE

BACKGROUND OF THE INVENTION

1. Field of the Invention

The present invention relates to the field of color conversion, and in particular to a method and apparatus for RGB color space gamut conversion and liquid crystal display device.

2. The Related Arts

Essentially, liquid crystal display (LCD) devices have the color dispersion problem. In addition, the use of photo-resistors and light sources will make the color performance on LCD very different from what human eyes experience in reality.

Color conversion is a technique to convert a color from one color space to another color space. There are many techniques to realize the color space conversion, such as, model method, neural network algorithm, and so on, wherein model method involves complicated computation process to find solutions and the conversion result is not always satisfactory, while the neural network algorithm approach requires a large amount of experiments, with each experiment requiring a long time. Furthermore, the above two approaches for color conversion also result in a large discrepancy between the LCD color performance and the actual color of an object.

Therefore, it is imperative to develop color conversion techniques to make the color performance of the LCD closer to, or even brighter and more vivid than, the actual color of the object.

SUMMARY OF THE INVENTION

The technical issue to be addressed by the present invention is to provide a method and apparatus for RGB color space gamut conversion and a liquid crystal display device, which is easier to construct a reverse conversion model, and implement the conversion algorithm with fast computation so that the color performance can be closer to the actual object color or closer to expected effect than the actual object color.

An exemplary embodiment of the present invention provides a method for RGB color space gamut conversion, including the following steps:

inputting RGB-based source graphic data;

dividing the RGB color space having all the colors corresponding to source graphic data into m*n*k source cubes, where 0<m, n, k<256;

defining eight vertices of each source cube as a, b, c, d, e, f, g, and h, where a=(Ra, Ga, Ba), b=(Rb, Gb, Bb), . . . , h=(Rh, Gh, Bh), and defining eight vertices of the target cube converted from source cube through gamut conversion as a', b', c', d', e', f', g', and h', where a'=(Ra', Ga', Ba'), b=(Rb', Gb', Bb'), . . . , h=(Rh', Gh', Bh');

projecting any point o in the RGB color space having all the colors corresponding to source graphic data onto point N on the plane formed by four vertices e, f, g and h of source cube and onto point M on the plane formed by four vertices a, b, c and d of source cube, where o=(Ro, Go, Bo), N=($R_N$, $G_N$, $B_N$), M=($R_M$, $G_M$, $B_M$), defining the point in the target cube corresponding to point o in the RGB color space having all the colors corresponding to source graphic data as point o' and projecting point o' in the target cube onto point N' on the plane formed by four vertices e', f', g' and h' of target cube and onto point M' on the plane formed by four vertices a', b', c' and d' of target cube, where o'=(Ro', Go', Bo'), N'=($R_{N'}$, $G_{N'}$, $B_{N'}$), M'=($R_{M'}$, $G_{M'}$, $B_{M'}$), point N on the plane formed by four vertices e, f, g, and h of source cube and point N' on the plane formed by four vertices e', f', g' and h' of target cube satisfying a first matrix equation, point M on the plane formed by four vertices a, b, c, and d of source cube and point M' on the plane formed by four vertices a', b', c' and d' of target cube satisfying a first matrix equation satisfying a second matrix equation;

based on the first matrix equation between point N on the plane formed by four vertices e, f, g, and h of source cube and point N' on the plane formed by four vertices e', f', g' and h' of target cube, computing point N' on the plane formed by four vertices e', f', g' and h' of target cube, and based on the second matrix equation between point M on the plane formed by four vertices a, b, c, and d of source cube and point M' on the plane formed by four vertices a', b', c' and d' of target cube, computing point M' on the plane formed by four vertices a', b', c' and d' of target cube;

based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data; and outputting or preserving the data of point o' in the target cube corresponding to point o in the RGB color space having all the colors corresponding to source graphic data, and the data of all points o's in the target cube forming the target color after the color gamut conversion;

wherein the first matrix equation is:

$$\begin{bmatrix} R'_N \\ G'_N \\ B'_N \end{bmatrix} = \begin{bmatrix} a_{11} & a_{12} & a_{13} \\ a_{21} & a_{22} & a_{23} \\ a_{31} & a_{32} & a_{33} \end{bmatrix} \times \begin{bmatrix} R_N \\ G_N \\ B_N \end{bmatrix}$$

wherein the second matrix equation is:

$$\begin{bmatrix} R'_M \\ G'_M \\ B'_M \end{bmatrix} = \begin{bmatrix} b_{11} & b_{12} & b_{13} \\ b_{21} & b_{22} & b_{23} \\ b_{31} & b_{32} & b_{33} \end{bmatrix} \times \begin{bmatrix} R_M \\ G_M \\ B_M \end{bmatrix}$$

wherein the step of computing the data of point o' in the target cube corresponding to point o in the RGB color space having all the colors corresponding to source graphic data, based on the computed point N' on the plane formed by four vertices e', f', g' and h' of target cube and the computed point M' on the plane formed by four vertices a', b', c' and d' of target cube further includes the steps:

defining $\overline{NO}$ as the distance between point N on the plane formed by four vertices e, f, g, and h of source cube and any point o in the source cube, $\overline{MO}$ as the distance between point M on the plane formed by four vertices a, b, c, and d of source cube and any point o in the source cube, $\overline{N'O'}$ as the distance between point N' on the plane formed by four vertices e', f', g', and h' of target cube and point o' in the target cube corresponding to any point o, and $\overline{M'O'}$ as the distance between point M' on the plane formed by four vertices a', b', c', and d' of target cube and point o' in the target cube corresponding to any point o;

based on the equation among point N' on the plane formed by four vertices e', f', g', and h' of target cube, point M' on the plane formed by four vertices a', b', c', and d' of target cube and point o' in the target cube corresponding to any point o, computing the data of point o' in the target cube corresponding to point o in the RGB color space having all the colors corresponding to source graphic data, wherein the above equation is:

$$R_{o'} = R_{N'} + (R_{M'} - R_{N'}) * \frac{\overline{NO}}{\overline{NO} + \overline{MO}}$$

$$G_{o'} = G_{N'} + (G_{M'} - G_{N'}) * \frac{\overline{NO}}{\overline{NO} + \overline{MO}}$$

$$\frac{\overline{MO}}{\overline{NO}} = \frac{\overline{M'O'}}{\overline{N'O'}} \quad B_{o'} = B_{N'} + (B_{M'} - B_{N'}) * \frac{\overline{NO}}{\overline{NO} + \overline{MO}}$$

wherein m*n*k source cubes are the m*n*k source right cubes, with m, n and k all having equal values;

wherein m*n*k source cubes are the m*n*k source rectangular cuboids, with two of m, n and k having equal values.

Another exemplary embodiment of the present invention provides an apparatus for RGB color space gamut conversion, including the following modules:

a source data registration module, for inputting RGB-based source graphic data;

a division module, for dividing the RGB color space having all the colors corresponding to source graphic data into m*n*k source cubes, where 0<m, n, k<256;

a definition module, for defining eight vertices of each source cube as a, b, c, d, e, f, g, and h, where a=(Ra, Ga, Ba), b=(Rb, Gb, Bb), . . . , h=(Rh, Gh, Bh), and defining eight vertices of the target cube converted from source cube through gamut conversion as a', b', c', d', e', f', g', and h', where a'=(Ra', Ga', Ba'), b=(Rb', Gb', Bb'), . . . , h=(Rh', Gh', Bh');

a projection module, for projecting any point o in the RGB color space having all the colors corresponding to source graphic data onto point N on the plane formed by four vertices e, f, g and h of source cube and onto point M on the plane formed by four vertices a, b, c and d of source cube, where o=(Ro, Go, Bo), N=($R_N$, $G_N$, $B_N$), M=($R_M$, $G_M$, $B_M$), defining the point in the target cube corresponding to point o in the RGB color space having all the colors corresponding to source graphic data as point o' and projecting point o' in the target cube onto point N' on the plane formed by four vertices e', f', g' and h' of target cube and onto point M' on the plane formed by four vertices a', b', c' and d' of target cube, where o'=(Ro', Go', Bo'), N'=($R_{N'}$, $G_{N'}$, $B_{N'}$), M'=($R_{M'}$, $G_{M'}$, $B_{M'}$), point N on the plane formed by four vertices e, f, g, and h of source cube and point N' on the plane formed by four vertices e', f', g' and h' of target cube satisfying a first matrix equation, point M on the plane formed by four vertices a, b, c, and d of source cube and point M' on the plane formed by four vertices a', b', c' and d' of target cube satisfying a first matrix equation satisfying a second matrix equation;

a first computation module, for performing the following computations: based on the first matrix equation between point N on the plane formed by four vertices e, f, g, and h of source cube and point N' on the plane formed by four vertices e', f', g' and h' of target cube, computing point N' on the plane formed by four vertices e', f', g' and h' of target cube, and based on the second matrix equation between point M on the plane formed by four vertices a, b, c, and d of source cube and point M' on the plane formed by four vertices a', b', c' and d' of target cube, computing point M' on the plane formed by four vertices a', b', c' and d' of target cube;

a second computation modules, for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data; and a target data outputting module, for outputting or preserving the data of point o' in the target cube corresponding to point o in the RGB color space having all the colors corresponding to source graphic data, and the data of all points o's in the target cube forming the target color after the color gamut conversion.

Yet another exemplary embodiment of the present invention provides a liquid crystal display device, including the following modules:

a source data registration module, for inputting RGB-based source graphic data;

a division module, for dividing the RGB color space having all the colors corresponding to source graphic data into m*n*k source cubes, where 0<m, n, k<256;

a definition module, for defining eight vertices of each source cube as a, b, c, d, e, f, g, and h, where a=(Ra, Ga, Ba), b=(Rb, Gb, Bb), . . . , h=(Rh, Gh, Bh), and defining eight vertices of the target cube converted from source cube through gamut conversion as a', b', c', d', e', f', g', and h', where a'=(Ra', Ga', Ba'), b=(Rb', Gb', Bb'), . . . , h=(Rh', Gh', Bh');

a projection module, for projecting any point o in the RGB color space having all the colors corresponding to source graphic data onto point N on the plane formed by four vertices e, f, g and h of source cube and onto point M on the plane formed by four vertices a, b, c and d of source cube, where o=(Ro, Go, Bo), N=($R_N$, $G_N$, $B_N$), M=($R_M$, $G_M$, $B_M$), defining the point in the target cube corresponding to point o in the RGB color space having all the colors corresponding to source graphic data as point o' and projecting point o' in the target cube onto point N' on the plane formed by four vertices e', f', g' and h' of target cube and onto point M' on the plane formed by four vertices a', b', c' and d' of target cube, where o'=(Ro', Go', Bo'), N'=($R_{N'}$, $G_{N'}$, BO, M'=($R_{M'}$, $G_{M'}$, $B_{M'}$), point N on the plane formed by four vertices e, f, g, and h of source cube and point N' on the plane formed by four vertices e', f', g' and h' of target cube satisfying a first matrix equation, point M on the plane formed by four vertices a, b, c, and d of source cube and point M' on the plane formed by four vertices a', b', c' and d' of target cube satisfying a first matrix equation satisfying a second matrix equation;

a first computation module, for performing the following computations: based on the first matrix equation between point N on the plane formed by four vertices e, f, g, and h of source cube and point N' on the plane formed by four vertices e', f', g' and h' of target cube, computing point N' on the plane formed by four vertices e', f', g' and h' of target cube, and based on the second matrix equation between point M on the plane formed by four vertices a, b, c, and d of source cube and point M' on the plane formed by four vertices a', b', c' and d' of target cube, computing point M' on the plane formed by four vertices a', b', c' and d' of target cube;

a second computation modules, for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data;

a target data outputting module, for outputting or preserving the data of point o' in the target cube corresponding to point o in the RGB color space having all the colors corresponding to source graphic data, and the data of all points o's in the target cube forming the target color after the color gamut conversion; and a display module, for displaying the target graphic data according to the target color after the described color gamut conversion.

The efficacy of the present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, projects point o' in the target cube corresponding to point o onto a point N' on the upper plane of a target cube and onto a point M' on the lower place of a target cube; based on a matrix equation between point N on the upper plane of source cube and point N' on the upper plane of target cube, and based on a matrix equation between point M on the lower plane of source cube and point M' on the lower plane of target cube, computes point N' on the upper plane of target cube and point M' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate the specific color.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

The following detailed description refers to the Figures and the embodiments of the present invention.

Figure 1:
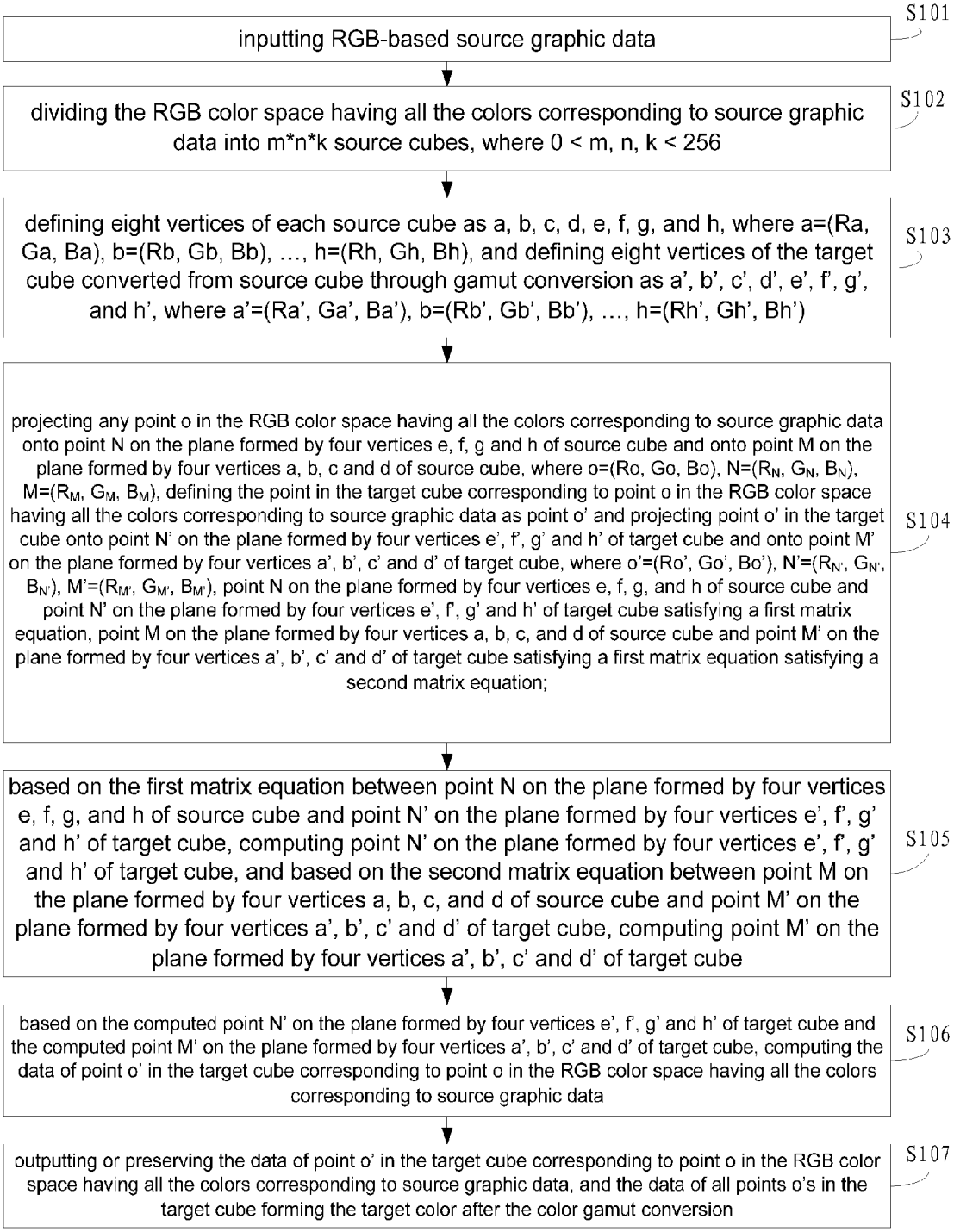
FIG. 1 is a schematic view showing the flowchart of an embodiment of RGB color space gamut conversion method according to the present invention.

FIG. 1 is a schematic view showing the flowchart of an embodiment of RGB color space gamut conversion method according to the present invention. As shown in FIG. 1, the method includes the following steps:

Step S101: inputting RGB-based source graphic data;

RGB color space uses the three basic colors in physics to represent colors. Any color can be obtained by mixing different amounts of red (R), green (G) and blue (B). The RGB space can also be described by a three-dimensional cube. The theory is to obtain all colors through the changes of red, green and blue color channels and the addition among the three color channels. The RGB represents the three color channels. This standard specification covers almost all the colors that human eyes can sense, and is one of the most widely used color systems. Each of the RGB factors of each pixel in the graph is allocated with a value ranging from 0 to 255. The RGB graph only uses three colors. With mixtures of different ratios, the monitor can display tens of millions of colors.

Step S102: dividing the RGB color space having all the colors corresponding to source graphic data into m*n*k source cubes, where 0<m, n, k<256;

The RGB color space having all the colors corresponding to source graphic data has a large range. By dividing the RGB color space having all the colors corresponding to source graphic data, the large RGB color space having all the colors corresponding to source graphic data can be divided into smaller ranges. For example, the RGB color space having all the colors corresponding to source graphic data can be divided into 5*7*9, 50*70*90 or 100*140*180 source cubes. With m, n and k increasing, the division is finer and the range of each source cube is smaller.

Figure 2:
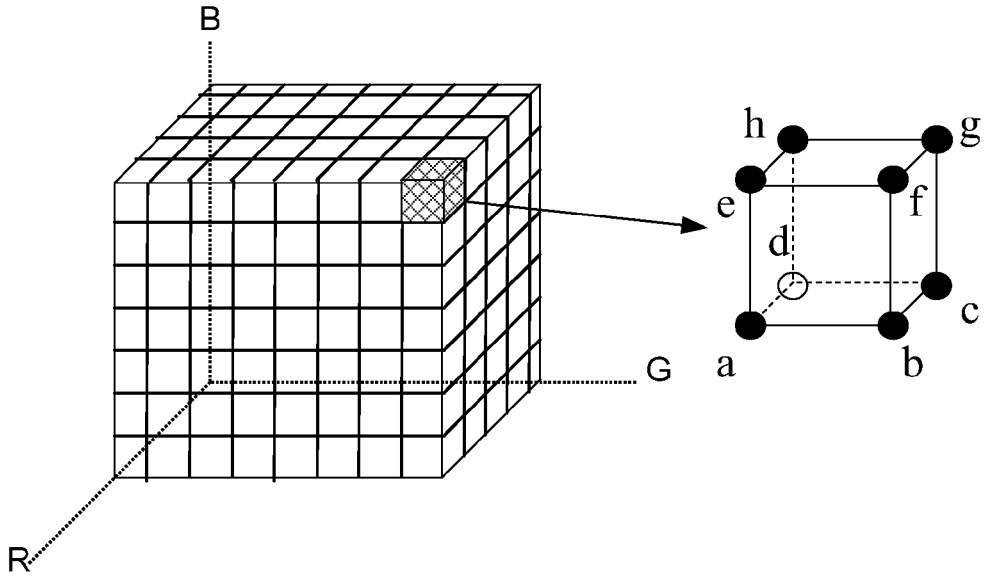
FIG. 2 is a schematic view showing an embodiment of RGB color space gamut conversion method dividing the RGB color space into a plurality of source cubes according to the present invention.
Figure 3:
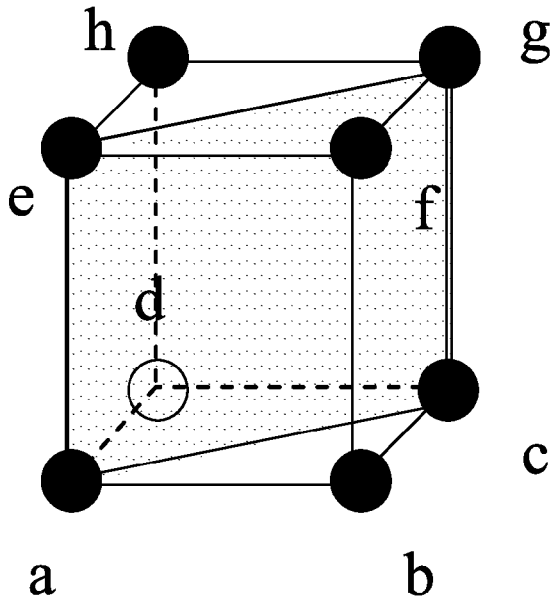
FIG. 3 is a schematic view showing a source cube in an embodiment of RGB color space gamut conversion method according to the present invention.
Figure 4:
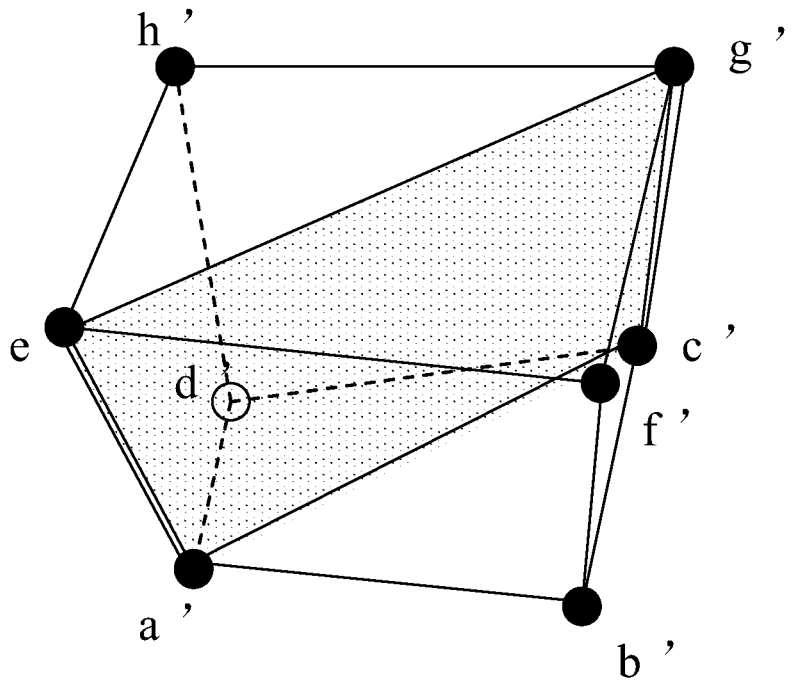
FIG. 4 is a schematic view showing a source cube and a corresponding target cube in an embodiment of RGB color space gamut conversion method according to the present invention.

Step S103: defining eight vertices of each source cube as a, b, c, d, e, f, g, and h, where a=(Ra, Ga, Ba), b=(Rb, Gb, Bb), . . . , h=(Rh, Gh, Bh), and defining eight vertices of the target cube converted from source cube through gamut conversion as a', b', c', d', e', f', g', and h', where a'=(Ra', Ga', Ba'), b=(Rb', Gb', Bb'), . . . , h=(Rh', Gh', Bh');

As shown in FIG. 2, the RGB color space 256*256*256 (8-bit grayscale representation of R, G and B=0, 1, . . . , 255) of source graphic data is divided into m*n*k source cubes (or m*m*m source right cubes). Each source cube has eight vertices, indicated as a, b, c, d, e, f, g, and h, as shown in FIG. 2 and FIG. 3. The colors in each source cube, according to the user's preference, are to be adjusted to the ultimate color performance. The corresponding target cube for new R', G' and B' color signals has eight vertices, indicated as a', b', c', d', e', f', g' and h'. At this point, the eight vertices of the target cube are the adjusted ultimate color performance, the data of vertices a', b', c', d', e', f', g', h' and R', G', B' are known data, as shown in FIG. 4. As seen in FIG. 3 and FIG. 4, the new corresponding target cube is no longer a right cube, but has different angles and sizes in different directions.

Step S104: projecting any point o in the RGB color space having all the colors corresponding to source graphic data onto point N on the plane formed by four vertices e, f, g and h of source cube and onto point M on the plane formed by four vertices a, b, c and d of source cube, where o=(Ro, Go, Bo), N=($R_N$, $G_N$, $B_N$), M=($R_M$, $G_M$, $B_M$), defining the point in the target cube corresponding to point o in the RGB color space having all the colors corresponding to source graphic data as point o' and projecting point o' in the target cube onto point N' on the plane formed by four vertices e', f', g' and h' of target cube and onto point M' on the plane formed by four vertices a', b', c' and d' of target cube, where o'=(Ro', Go', Bo'), N'=($R_{N'}$, $G_{N'}$, BO, M'=($R_{M'}$, $G_{M'}$, $B_{M'}$), point N on the plane formed by four vertices e, f, g, and h of source cube and point N' on the plane formed by four vertices e', f', g' and h' of target cube satisfying a first matrix equation, point M on the plane formed by four vertices a, b, c, and d of source cube and point M' on the plane formed by four vertices a', b', c' and d' of target cube satisfying a first matrix equation satisfying a second matrix equation;

Through the simplification process of projecting any point o in the RGB color space having all the colors corresponding to source graphic data onto point N on the plane formed by four vertices e, f, g and h of source cube and onto point M on the plane formed by four vertices a, b, c and d of source cube, and projecting point o' in the target cube onto point N' on the plane formed by four vertices e', f', g' and h' of target cube and onto point M' on the plane formed by four vertices a', b', c' and d' of target cube, the point in RGC color space is converted to the related point on the RGB plane. Through the computation of related point on the RGB plane, the point in the RGB color space can be computed.

The matrix refers to a two-dimensional data table arranged in rows and columns, and is a tool for solving linear equations. The matrix equation refers to the known point on the plane of source cube and a corresponding unknown point on the plane of target cube satisfying a specific matrix equation.

Figure 5:
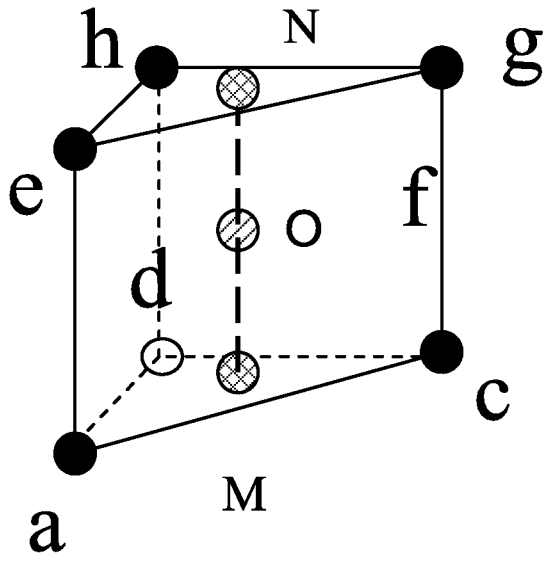
FIG. 5 is a schematic view showing projecting any point in a source cube in an embodiment of RGB color space gamut conversion method according to the present invention.
Figure 6:
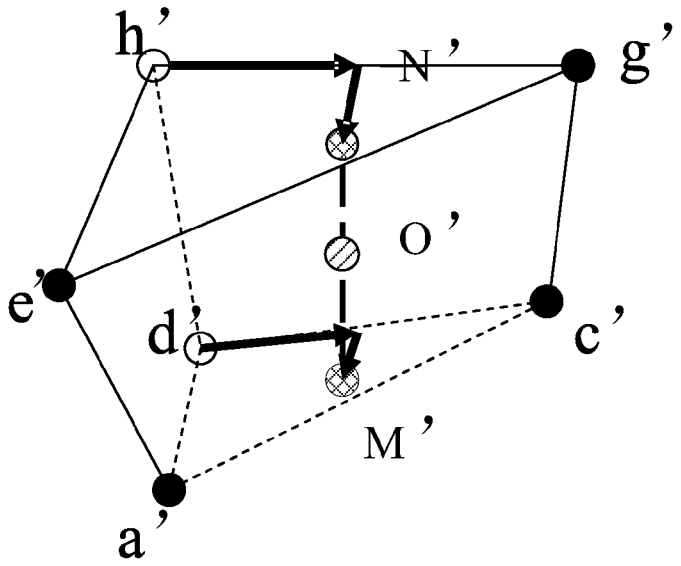
FIG. 6 is a schematic view showing projecting a point in target cube corresponding to a point in a source cube in an embodiment of RGB color space gamut conversion method according to the present invention.

Step S105: based on the first matrix equation between point N on the plane formed by four vertices e, f, g, and h of source cube and point N' on the plane formed by four vertices e', f', g' and h' of target cube, computing point N' on the plane formed by four vertices e', f', g' and h' of target cube, and based on the second matrix equation between point M on the plane formed by four vertices a, b, c, and d of source cube and point M' on the plane formed by four vertices a', b', c' and d' of target cube, computing point M' on the plane formed by four vertices a', b', c' and d' of target cube;

As shown in FIG. 5 and FIG. 6, if a point o inside the source cube having eight vertices a, b, c, d, e, f, g and h is located inside a triangular prism A1 formed by six vertices a, c, d, e, g and h, the converted point o' inside the target cube having eight vertices a', b', c', d', e', f', g' and h' must be also located inside the triangular prism A1' formed by six vertices a', c', d', e', g' and h'. Three vertices e, g, and h of source cube form an upper surface S1. Three vertices e', g' and h' of target cube form an upper surface S1', According to the matrix mapping equation between three vertices e, g and h of upper surface S1 and three vertices e', g' and h' of upper surface S1', any point N on upper surface S1 can be used to compute corresponding point N' on upper surface S1' through the use of matrix mapping equation.

Similarly, three vertices a, c, and d of source cube form a lower surface S2. Three vertices a', c' and d' of target cube form a lower surface S2', According to the matrix mapping equation between three vertices a, c and d of lower surface S2 and three vertices a', c' and d' of lower surface S2', any point M on lower surface S2 can be used to compute corresponding point M' on lower surface S2' through the use of matrix mapping equation.

If a point o inside the source cube having eight vertices a, b, c, d, e, f, g and h is located inside a triangular prism A2 formed by six vertices a, b, c, e, f and g, the converted point o' inside the target cube having eight vertices a', b', c', d', e', f', g' and h' must be also located inside the triangular prism A2' formed by six vertices a', b', c', e', f' and g'. Three vertices e, f, and g of source cube form an upper surface S3. Three vertices e', f' and g' of target cube form an upper surface S3'. According to the matrix mapping equation between three vertices e, f and g of upper surface S3 and three vertices e', f' and g' of upper surface S3', any point N on upper surface S3 can be used to compute corresponding point N' on upper surface S3' through the use of matrix mapping equation.

Similarly, three vertices a, b, and c of source cube form a lower surface S4. Three vertices a', b' and c' of target cube form a lower surface S4', According to the matrix mapping equation between three vertices a, b and c of lower surface S4 and three vertices a', b' and c' of lower surface S4', any point M on lower surface S4 can be used to compute corresponding point M' on lower surface S4' through the use of matrix mapping equation.

Step S106: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data;

Based on the two projected points N' and M' by point o' in the target cube corresponding to point o in the RGB color space having all the colors corresponding to source graphic data, this step is to compute the data of point o' in the target cube corresponding to point o in the RGB color space having the source graphic data.

Step S107: outputting or preserving the data of point o' in the target cube corresponding to point o in the RGB color space having all the colors corresponding to source graphic data, and the data of all points o's in the target cube forming the target color after the color gamut conversion.

Figure 7:
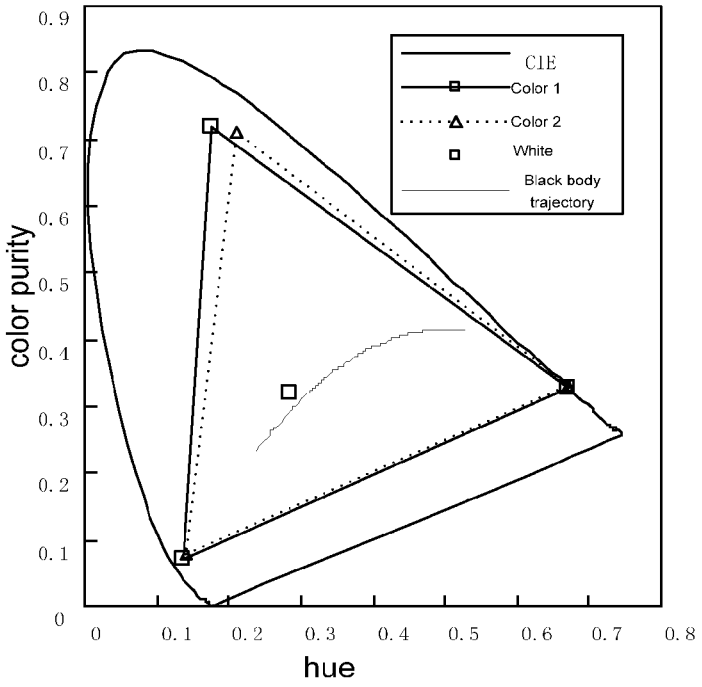
FIG. 7 is a schematic view showing a plot of two-dimensional hue and color purity in CIE 1931 color space.

FIG. 7 is a schematic view showing a plot of two-dimensional hue and color purity in CIE 1931 color space. As shown in FIG. 7, the RGB input signal of source graph has the color performance, such as chroma contents of "color 1", in CIE 1931 color space. After converting the R, G, B signals and based on the color preference, the source color can be converted from "color 1" into "color 2" to make the source green color appearing yellowish. Through the signal conversion, the hue of greenish color displayed on the monitor can be converted to the yellowish color to soften the overall image.

The aforementioned first matrix equation is expressed as follows:

$$\begin{bmatrix} R'_N \\ G'_N \\ B'_N \end{bmatrix} = \begin{bmatrix} a_{11} & a_{12} & a_{13} \\ a_{21} & a_{22} & a_{23} \\ a_{31} & a_{32} & a_{33} \end{bmatrix} \times \begin{bmatrix} R_N \\ G_N \\ B_N \end{bmatrix}$$

First matrix equation is the relation between point N projected by any point o in the RGB color space having the source graphic data and point N' projected by corresponding point o' in target cube. In the first matrix equation, the matrix on the left side of the equation is the target matrix. The first matrix on the right side of the equation is a coefficient matrix and the second matrix on the right side of the equation is the variable matrix. In actual application, point N projected by any point o in the RGB color space having the source graphic data and point N' projected by corresponding point o' in target cube can also satisfy other equations.

The aforementioned second matrix equation is expressed as follows:

$$\begin{bmatrix} R'_M \\ G'_M \\ B'_M \end{bmatrix} = \begin{bmatrix} b_{11} & b_{12} & b_{13} \\ b_{21} & b_{22} & b_{23} \\ b_{31} & b_{32} & b_{33} \end{bmatrix} \times \begin{bmatrix} R_M \\ G_M \\ B_M \end{bmatrix}$$

Second matrix equation is the relation between point M projected by any point o in the RGB color space having the source graphic data and point M' projected by corresponding point o' in target cube. In the second matrix equation, the matrix on the left side of the equation is the target matrix. The first matrix on the right side of the equation is a coefficient matrix and the second matrix on the right side of the equation is the variable matrix. In actual application, point M projected by any point o in the RGB color space having the source graphic data and point M' projected by corresponding point o' in target cube can also satisfy other equations.

Furthermore, the step of computing the data of point o' in the target cube corresponding to point o in the RGB color space having all the colors corresponding to source graphic data, based on the computed point N' on the plane formed by four vertices e', f', g' and h' of target cube and the computed point M' on the plane formed by four vertices a', b', c' and d' of target cube further includes the following steps:

defining $\overline{NO}$ as the distance between point N on the plane formed by four vertices e, f, g, and h of source cube and any point o in the source cube, $\overline{MO}$ as the distance between point M on the plane formed by four vertices a, b, c, and d of source cube and any point o in the source cube, $\overline{N'O'}$ as the distance between point N' on the plane formed by four vertices e', f', g', and h' of target cube and point o' in the target cube corresponding to any point o, and $\overline{M'O'}$ as the distance between point M' on the plane formed by four vertices a', b', c', and d' of target cube and point o' in the target cube corresponding to any point o;

based on the equation among point N' on the plane formed by four vertices e', f', g', and h' of target cube, point M' on the plane formed by four vertices a', b', c', and d' of target cube and point o' in the target cube corresponding to any point o, computing the data of point o' in the target cube corresponding to point o in the RGB color space having all the colors corresponding to source graphic data, wherein the above equation is:

$$R_{o'} = R_{N'} + (R_{M'} - R_{N'}) * \frac{\overline{NO}}{\overline{NO} + \overline{MO}}$$

$$G_{o'} = G_{N'} + (G_{M'} - G_{N'}) * \frac{\overline{NO}}{\overline{NO} + \overline{MO}}$$

$$\frac{\overline{MO}}{\overline{NO}} = \frac{\overline{M'O'}}{\overline{N'O'}} \quad B_{o'} = B_{N'} + (B_{M'} - B_{N'}) * \frac{\overline{NO}}{\overline{NO} + \overline{MO}}$$

Based on the above equation, the data of point o' in the target cube corresponding to point o in the RGB color space having all the colors corresponding to source graphic data can be computed.

wherein m*n*k source cubes are the m*n*k source right cubes, with m, n and k all having equal values;

The present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, projects point o' in the target cube corresponding to point o onto a point N' on the upper plane of a target cube and onto a point M' on the lower place of a target cube; based on a matrix equation between point N on the upper plane of source cube and point N' on the upper plane of target cube, and based on a matrix equation between point M on the lower plane of source cube and point M' on the lower plane of target cube, computes point N' on the upper plane of target cube and point M' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate the specific color.

Figure 8:
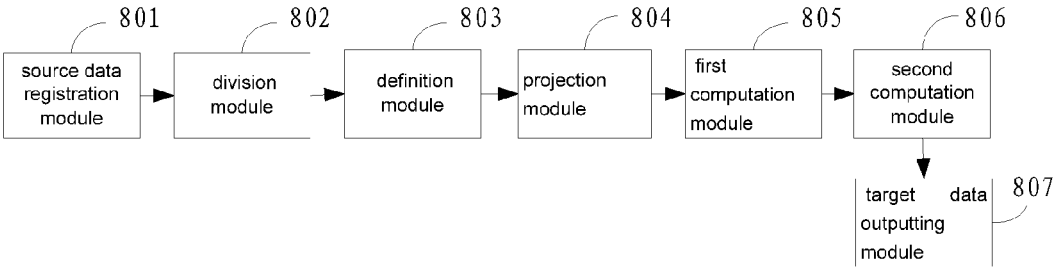
FIG. 8 is a schematic view showing an embodiment of RGB color space gamut conversion apparatus according to the present invention.

FIG. 8 is a schematic view showing an embodiment of RGB color space gamut conversion apparatus according to the present invention. As shown in FIG. 8, the apparatus includes a source data registration module 801, a division module 802, a definition module 803, a projection module 804, a first computation module 805, a second computation module 806 and a target data outputting module 807.

Source data registration module 801 is for inputting RGB-based source graphic data.

RGB color space uses the three basic colors in physics to represent colors. Any color can be obtained by mixing different amounts of red (R), green (G) and blue (B). The RGB space can also be described by a three-dimensional cube. The theory is to obtain all colors through the changes of red, green and blue color channels and the addition among the three color channels. The RGB represents the three color channels. This standard specification covers almost all the colors that human eyes can sense, and is one of the most widely used color systems. Each of the RGB factors of each pixel in the graph is allocated with a value ranging from 0 to 255. The RGB graph only uses three colors. With mixtures of different ratios, the monitor can display tens of millions of colors.

Division module 802 is for dividing the RGB color space having all the colors corresponding to source graphic data into m*n*k source cubes, where 0<m, n, k<256.

The RGB color space having all the colors corresponding to source graphic data has a large range. By dividing the RGB color space having all the colors corresponding to source graphic data, the large RGB color space having all the colors corresponding to source graphic data can be divided into smaller ranges.

Definition module 803 is for defining eight vertices of each source cube as a, b, c, d, e, f, g, and h, where a=(Ra, Ga, Ba), b=(Rb, Gb, Bb), . . . , h=(Rh, Gh, Bh), and defining eight vertices of the target cube converted from source cube through gamut conversion as a', b', c', d', e', f', g', and h', where a'=(Ra', Ga', Ba'), b=(Rb', Gb', Bb'), . . . , h=(Rh', Gh', Bh').

Projection module 804 is for projecting any point o in the RGB color space having all the colors corresponding to source graphic data onto point N on the plane formed by four vertices e, f, g and h of source cube and onto point M on the plane formed by four vertices a, b, c and d of source cube, where o=(Ro, Go, Bo), N=($R_N$, $G_N$, $B_N$), M=($R_M$, $G_M$, $B_M$), defining the point in the target cube corresponding to point o in the RGB color space having all the colors corresponding to source graphic data as point o' and projecting point o' in the target cube onto point N' on the plane formed by four vertices e', f', g' and h' of target cube and onto point M' on the plane formed by four vertices a', b', c' and d' of target cube, where o'=(Ro', Go', Bo'), N'=($R_{N'}$, $G_{N'}$, BO, M'=($R_{M'}$, $G_{M'}$, $B_{M'}$), point N on the plane formed by four vertices e, f, g, and h of source cube and point N' on the plane formed by four vertices e', f', g' and h' of target cube satisfying a first matrix equation, point M on the plane formed by four vertices a, b, c, and d of source cube and point M' on the plane formed by four vertices a', b', c' and d' of target cube satisfying a first matrix equation satisfying a second matrix equation.

Through the simplification process of projecting any point o in the RGB color space having all the colors corresponding to source graphic data onto point N on the plane formed by four vertices e, f, g and h of source cube and onto point M on the plane formed by four vertices a, b, c and d of source cube, and projecting point o' in the target cube onto point N' on the plane formed by four vertices e', f', g' and h' of target cube and onto point M' on the plane formed by four vertices a', b', c' and d' of target cube, the point in RGC color space is converted to the related point on the RGB plane. Through the computation of related point on the RGB plane, the point in the RGB color space can be computed.

The matrix refers to a two-dimensional data table arranged in rows and columns, and is a tool for solving linear equations. The matrix equation refers to the known point on the plane of source cube and a corresponding unknown point on the plane of target cube satisfying a specific matrix equation.

First computation module 805 is for performing the following computations: based on the first matrix equation between point N on the plane formed by four vertices e, f, g, and h of source cube and point N' on the plane formed by four vertices e', f', g' and h' of target cube, computing point N' on the plane formed by four vertices e', f', g' and h' of target cube, and based on the second matrix equation between point M on the plane formed by four vertices a, b, c, and d of source cube and point M' on the plane formed by four vertices a', b', c' and d' of target cube, computing point M' on the plane formed by four vertices a', b', c' and d' of target cube.

Second computation modules 806 is for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data.

Based on the two projected points N' and M' by point o' in the target cube corresponding to point o in the RGB color space having all the colors corresponding to source graphic data, this step is to compute the data of point o' in the target cube corresponding to point o in the RGB color space having the source graphic data.

Target data outputting module 807 is for outputting or preserving the data of point o' in the target cube corresponding to point o in the RGB color space having all the colors corresponding to source graphic data, and the data of all points o's in the target cube forming the target color after the color gamut conversion.

The present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, projects point o' in the target cube corresponding to point o onto a point N' on the upper plane of a target cube and onto a point M' on the lower place of a target cube; based on a matrix equation between point N on the upper plane of source cube and point N' on the upper plane of target cube, and based on a matrix equation between point M on the lower plane of source cube and point M' on the lower plane of target cube, computes point N' on the upper plane of target cube and point M' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate the specific color.

Figure 9:
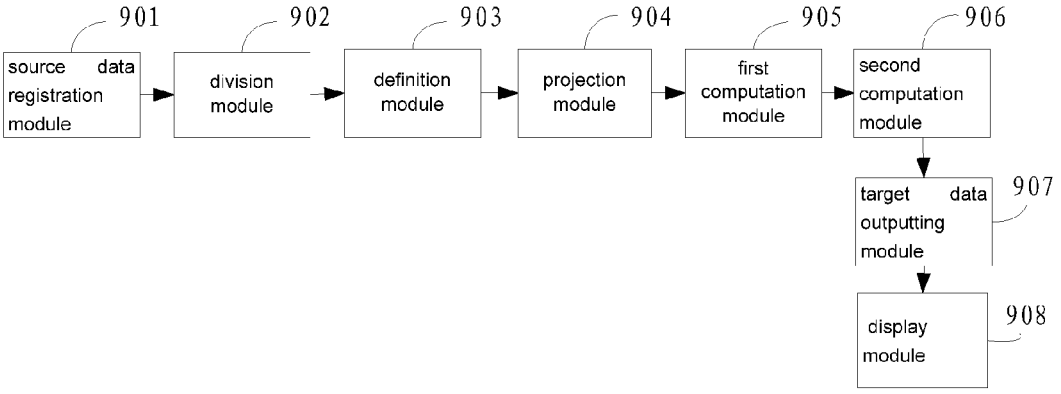
FIG. 9 is a schematic view showing an embodiment of liquid crystal display device according to the present invention.

FIG. 9 is a schematic view showing an embodiment of liquid crystal display device according to the present invention. As shown in FIG. 9, the liquid crystal display device includes a source data registration module 901, a division module 902, a definition module 903, a projection module 904, a first computation module 905, a second computation module 906, a target data outputting module 907 and a display module 908.

Source data registration module 901 is for inputting RGB-based source graphic data.

Division module 902 is for dividing the RGB color space having all the colors corresponding to source graphic data into m*n*k source cubes, where 0<m, n, k<256.

Definition module 903 is for defining eight vertices of each source cube as a, b, c, d, e, f, g, and h, where a=(Ra, Ga, Ba), b=(Rb, Gb, Bb), . . . , h=(Rh, Gh, Bh), and defining eight vertices of the target cube converted from source cube through gamut conversion as a', b', c', d', e', f', g', and h', where a'=(Ra', Ga', Ba'), b=(Rb', Gb', Bb'), . . . , h=(Rh', Gh', Bh').

Projection module 904 is for projecting any point o in the RGB color space having all the colors corresponding to source graphic data onto point N on the plane formed by four vertices e, f, g and h of source cube and onto point M on the plane formed by four vertices a, b, c and d of source cube, where o=(Ro, Go, Bo), N=($R_N$, $G_N$, $B_N$), M=($R_M$, $G_M$, $B_M$), defining the point in the target cube corresponding to point o in the RGB color space having all the colors corresponding to source graphic data as point o' and projecting point o' in the target cube onto point N' on the plane formed by four vertices e', f', g' and h' of target cube and onto point M' on the plane formed by four vertices a', b', c' and d' of target cube, where o'=(Ro', Go', Bo'), N'=($R_{N'}$, $G_{N'}$, $B_{N'}$), M'=($R_{M'}$, $G_{M'}$, $B_{M'}$), point N on the plane formed by four vertices e, f, g, and h of source cube and point N' on the plane formed by four vertices e', f', g' and h' of target cube satisfying a first matrix equation, point M on the plane formed by four vertices a, b, c, and d of source cube and point M' on the plane formed by four vertices a', b', c' and d' of target cube satisfying a first matrix equation satisfying a second matrix equation.

First computation module 905 is for performing the following computations: based on the first matrix equation between point N on the plane formed by four vertices e, f, g, and h of source cube and point N' on the plane formed by four vertices e', f', g' and h' of target cube, computing point N' on the plane formed by four vertices e', f', g' and h' of target cube, and based on the second matrix equation between point M on the plane formed by four vertices a, b, c, and d of source cube and point M' on the plane formed by four vertices a', b', c' and d' of target cube, computing point M' on the plane formed by four vertices a', b', c' and d' of target cube.

Second computation modules 906 is for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data.

Target data outputting module 907 is for outputting or preserving the data of point o' in the target cube corresponding to point o in the RGB color space having all the colors corresponding to source graphic data, and the data of all points o's in the target cube forming the target color after the color gamut conversion.

Display module 908 is for displaying the target graphic data according to the target color after the described color gamut conversion.

The present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, projects point o' in the target cube corresponding to point o onto a point N' on the upper plane of a target cube and onto a point M' on the lower place of a target cube; based on a matrix equation between point N on the upper plane of source cube and point N' on the upper plane of target cube, and based on a matrix equation between point M on the lower plane of source cube and point M' on the lower plane of target cube, computes point N' on the upper plane of target cube and point M' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate the specific color.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A color gamut conversion method based on RGB color space, applied to a liquid crystal display device, comprising the steps of:

inputting RGB-based source graphic data;

dividing RGB color space having all colors corresponding to said source graphic data into m*n*k source cubes, where 0<m, n, k<256;

defining eight vertices of each said source cube as a, b, c, d, e, f, g, and h, where a=(Ra, Ga, Ba), b=(Rb, Gb, Bb), . . . , h=(Rh, Gh, Bh), and defining eight vertices of target cube converted from said source cube through gamut conversion as a', b', c', d', e', f', g', and h', where a'=(Ra', Ga', Ba'), b=(Rb', Gb', Bb'), . . . , h=(Rh', Gh', Bh');

projecting any point o in said RGB color space having all colors corresponding to said source graphic data onto point N on a plane formed by four vertices e, f, g and h of said source cube and onto point M on a plane formed by four vertices a, b, c and d of source cube, where o=(Ro, Go, Bo), N=($R_N$, $G_N$, $B_N$), M=($R_M$, $G_M$, $B_M$), defining a point in said target cube corresponding to said point o in said RGB color space having all colors corresponding to source graphic data as point o' and projecting said point o' in said target cube onto point N' on a plane formed by four vertices e', f', g' and h' of target cube and onto point M' on a plane formed by four vertices a', b', c' and d' of target cube, where o'=(Ro', Go', Bo'), N'=($R_{N'}$, $G_{N'}$, $B_{N'}$), M'=($R_{M'}$, $G_{M'}$, $B_{M'}$), point N on said plane formed by four vertices e, f, g, and h of source cube and point N' on said plane formed by four vertices e', f', g' and h' of target cube satisfying a first matrix equation, point M on said plane formed by four vertices a, b, c, and d of source cube and point M' on said plane formed by four vertices a', b', c' and d' of target cube satisfying a second matrix equation;

based on said first matrix equation between point N on said plane formed by four vertices e, f, g, and h of source cube and point N' on said plane formed by four vertices e', f', g' and h' of target cube, computing point N' on said plane formed by four vertices e', f', g' and h' of target cube, and based on said second matrix equation between point M on said plane formed by four vertices a, b, c, and d of source cube and point M' on said plane formed by four vertices a', b', c' and d' of target cube, computing point M' on said plane formed by four vertices a', b', c' and d' of target cube;

based on computed point N' on said plane formed by four vertices e', f', g' and h' of target cube and computed point M' on said plane formed by four vertices a', b', c' and d' of target cube, computing data of point o' in said target cube corresponding to said point o in said RGB color space having all colors corresponding to said source graphic data;

outputting or preserving said data of point o' in said target cube corresponding to point o in said RGB color space having all colors corresponding to said source graphic data, and said data of all points o's in said target cube forming target color after color gamut conversion; and adjusting a color performance of said liquid crystal display device by displaying target graphic data according to said target color after said color gamut conversion;

wherein said source cubes are right cubes or rectangular cuboids, while said target cubes are not right cubes or are not rectangular cuboids and each have different angles and sizes in different directions;

wherein said step of based on computed point N' on said plane formed by four vertices e', f', g' and h' of target cube and computed point M' on said plane formed by four vertices a', b', c' and d' of target cube, computing data of point o' in said target cube corresponding to said point o in said RGB color space having all colors corresponding to said source graphic data further comprises the following steps:

defining $\overline{NO}$ as distance between point N on said plane formed by four vertices e, f, g, and h of source cube and any point o in said source cube, $\overline{MO}$ as distance between point M on said plane formed by four vertices a, b, c, and d of source cube and any point o in said source cube, $\overline{N'O'}$ as distance between point N' on said plane formed by four vertices e', f', g', and h' of target cube and point o' in said target cube corresponding to any point o, and $\overline{M'O'}$ as distance between point M' on said plane formed by four vertices a', b', c', and d' of target cube and point o' in said target cube corresponding to any point o; and based on an equation among point N' on said plane formed by four vertices e', f', g', and h' of target cube, point M' on said plane formed by four vertices a', b', c', and d' of target cube and point o' in said target cube corresponding to any point o, computing data of point o' in said target cube corresponding to point o in said RGB color space having all colors corresponding to said source graphic data, wherein said equation is:

$$R_{o'} = R_{N'} + (R_{M'} - R_{N'}) * \frac{\overline{NO}}{\overline{NO} + \overline{MO}}$$

$$G_{o'} = G_{N'} + (G_{M'} - G_{N'}) * \frac{\overline{NO}}{\overline{NO} + \overline{MO}}$$

$$\frac{\overline{MO}}{\overline{NO}} = \frac{\overline{M'O'}}{\overline{N'O'}} \quad B_{o'} = B_{N'} + (B_{M'} - B_{N'}) * \frac{\overline{NO}}{\overline{NO} + \overline{MO}}.$$

2. The method as claimed in claim 1, wherein said first matrix equation is:

$$\begin{bmatrix} R'_N \\ G'_N \\ B'_N \end{bmatrix} = \begin{bmatrix} a_{11} & a_{12} & a_{13} \\ a_{21} & a_{22} & a_{23} \\ a_{31} & a_{32} & a_{33} \end{bmatrix} \times \begin{bmatrix} R_N \\ G_N \\ B_N \end{bmatrix}.$$

3. The method as claimed in claim 1, wherein said second matrix equation is:

$$\begin{bmatrix} R'_M \\ G'_M \\ B'_M \end{bmatrix} = \begin{bmatrix} b_{11} & b_{12} & b_{13} \\ b_{21} & b_{22} & b_{23} \\ b_{31} & b_{32} & b_{33} \end{bmatrix} \times \begin{bmatrix} R_M \\ G_M \\ B_M \end{bmatrix}.$$

4. A color gamut conversion apparatus based on RGB color space, comprising: one or more processors; and a memory storing software modules executed by said one or more processors comprising:

a source data registration module, configured to input RGB-based source graphic data;

a division module, configured to divide RGB color space having all colors corresponding to said source graphic data into m*n*k source cubes, where 0<m, n, k<256;

a definition module, configured to define eight vertices of each said source cube as a, b, c, d, e, f, g, and h, where a=(Ra, Ga, Ba), b=(Rb, Gb, Bb), . . . , h=(Rh, Gh, Bh), and configured to define eight vertices of target cube converted from said source cube through gamut conversion as a', b', c', d', e', f', g', and h', where a'=(Ra', Ga', Ba'), b=(Rb', Gb', Bb'), . . . , h=(Rh', Gh', Bh');

a projection module, configured to project any point o in said RGB color space having all colors corresponding to said source graphic data onto point N on a plane formed by four vertices e, f, g and h of source cube and onto point M on a plane formed by four vertices a, b, c and d of source cube, where o=(Ro, Go, Bo), N=($R_N$, $G_N$, $B_N$), M=($R_M$, $G_M$, $B_M$), configured to define a point in said target cube corresponding to point o in said RGB color space having all colors corresponding to said source graphic data as point o' and configured to project said point o' in said target cube onto point N' on a plane formed by four vertices e', f', g' and h' of target cube and onto point M' on a plane formed by four vertices a', b', c' and d' of target cube, where o'=(Ro', Go', Bo'), N'=($R_{N'}$, $G_{N'}$, $B_{N'}$), M'=($R_{M'}$, $G_{M'}$, $B_{M'}$), point N on said plane formed by four vertices e, f, g, and h of source cube and point N' on said plane formed by four vertices e', f', g' and h' of target cube satisfying a first matrix equation, point M on said plane formed by four vertices a, b, c, and d of source cube and point M' on said plane formed by four vertices a', b', c' and d' of target cube satisfying a second matrix equation;

a first computation module, configured to perform following computations: based on said first matrix equation between point N on said plane formed by four vertices e, f, g, and h of source cube and point N' on said plane formed by four vertices e', f', g' and h' of target cube, computing point N' on said plane formed by four vertices e', f', g' and h' of target cube, and based on said second matrix equation between point M on said plane formed by four vertices a, b, c, and d of source cube and point M' on said plane formed by four vertices a', b', c' and d' of target cube, computing point M' on said plane formed by four vertices a', b', c' and d' of target cube;

a second computation module, configured to perform following computation: based on computed point N' on said plane formed by four vertices e', f', g' and h' of target cube and computed point M' on said plane formed by four vertices a', b', c' and d' of target cube, computing data of point o' in said target cube corresponding to point o in said RGB color space having all colors corresponding to source graphic data; and a target data outputting module, configured to output or preserve said data of point o' in said target cube corresponding to point o in said RGB color space having all colors corresponding to source graphic data, and said data of all points o's in said target cube forming target color after color gamut conversion;

wherein said source cubes are right cubes or rectangular cuboids, while said target cubes are not right cubes or are not rectangular cuboids and each have different angles and sizes in different directions;

wherein said second computation module configured to perform said following computation of: based on computed point N' on said plane formed by four vertices e', f', g' and h' of target cube and computed point M' on said plane formed by four vertices a', b', c' and d' of target cube, computing data of point o' in said target cube corresponding to point o in said RGB color space having all colors corresponding to source graphic data comprises:

configured to define $\overline{NO}$ as distance between point N on said plane formed by four vertices e, f, g, and h of source cube and any point o in said source cube, $\overline{MO}$ as distance between point M on said plane formed b four vertices a, b, c and d of source cube and any point o in said source cube, $\overline{N'O'}$ as distance between point N' on said plane formed by four vertices e', f', g', and h' of target cube and point o' in said target cube corresponding to any point o, and $\overline{M'O'}$ as distance between point M' on said plane formed by four vertices a', b', c', and d' of target cube and point o' in said target cube corresponding to any point o; and based on an equation among point N' on said plane formed by four vertices e', f', g', and h' of target cube, point M' on said plane formed by four vertices a', b', c', and d' of target cube and point o' in said target cube corresponding to any point o, configured to compute data of point o' in said target cube corresponding to point o in said RGB color space having all colors corresponding to said source graphic data, wherein said equation is:

$$R_{o'} = R_{N'} + (R_{M'} - R_{N'}) * \frac{\overline{NO}}{\overline{NO} + \overline{MO}}$$

$$G_{o'} = G_{N'} + (G_{M'} - G_{N'}) * \frac{\overline{NO}}{\overline{NO} + \overline{MO}}$$

$$\frac{\overline{MO}}{\overline{NO}} = \frac{\overline{M'O'}}{\overline{N'O'}} \quad B_{o'} = B_{N'} + (B_{M'} - B_{N'}) * \frac{\overline{NO}}{\overline{NO} + \overline{MO}}.$$

5. A liquid crystal display device, comprising:

one or more processors;

a memory storing software modules executed by the one or more processors comprising:

a source data registration module, configured to input RGB-based source graphic data;

a division module, configured to divide RGB color space having all colors corresponding to said source graphic data into m*n*k source cubes, where 0<m, n, k<256;

a definition module, configured to define eight vertices of each said source cube as a, b, c, d, e, f, g, and h, where a=(Ra, Ga, Ba), b=(Rb, Gb, Bb), . . . , h=(Rh, Gh, Bh), and configured to define eight vertices of target cube converted from said source cube through gamut conversion as a', b', c', d', e', f', g', and h', where a'=(Ra', Ga', Ba'), b=(Rb', Gb', Bb'), . . . , h=(Rh', Gh', Bh');

a projection module, configured to project any point o in said RGB color space having all colors corresponding to said source graphic data onto point N on a plane formed by four vertices e, f, g and h of source cube and onto point M on a plane formed by four vertices a, b, c and d of source cube, where o=(Ro, Go, Bo), N=($R_N$, $G_N$, $B_N$), M=($R_M$, $G_M$, $B_M$), configured to define a point in said target cube corresponding to point o in said RGB color space having all colors corresponding to said source graphic data as point o' and configured to project said point o' in said target cube onto point N' on a plane formed by four vertices e', f', g' and h' of target cube and onto point M' on a plane formed by four vertices a', b', c' and d' of target cube, where o'=(Ro', Go', Bo'), N'=($R_{N'}$, $G_{N'}$, $B_{N'}$), M'=($R_{M'}$, $G_{M'}$, $B_{M'}$), point N on said plane formed by four vertices e, f, g, and h of source cube and point N' on said plane formed by four vertices e', f', g' and h' of target cube satisfying a first matrix equation, point M on said plane formed by four vertices a, b, c, and d of source cube and point M' on said plane formed by four vertices a', b', c' and d' of target cube satisfying a second matrix equation;

a first computation module, configured to perform following computations: based on said first matrix equation between point N on said plane formed by four vertices e, f, g, and h of source cube and point N' on said plane formed by four vertices e', f', g' and h' of target cube, computing point N' on said plane formed by four vertices e', f', g' and h' of target cube, and based on said second matrix equation between point M on said plane formed by four vertices a, b, c, and d of source cube and point M' on said plane formed by four vertices a', b', c' and d' of target cube, computing point M' on said plane formed by four vertices a', b', c' and d' of target cube; and a second computation module, configured to perform following computation: based on computed point N' on said plane formed by four vertices e', f', g' and h' of target cube and computed point M' on said plane formed by four vertices a', b', c' and d' of target cube, computing data of point o' in said target cube corresponding to point o in said RGB color space having all colors corresponding to source graphic data;

a target data outputting module, configured to output or preserve said data of point o' in said target cube corresponding to point o in said RGB color space having all colors corresponding to source graphic data, and said data of all points o's in said target cube forming target color after color gamut conversion; and a display module, configured to display target graphic data according to said target color after said color gamut conversion and thereby achieving the adjustment of color performance of the liquid crystal display device;

wherein said source cubes are right cubes or rectangular cuboids, while said target cubes are not right cubes or are not rectangular cuboids and each have different angles and sizes in different directions;

wherein said second computation module configured to perform said following computation of: based on computed point N' on said plane formed by four vertices e', f', g' and h' of target cube and computed point M' on said plane formed by four vertices a', b', c' and d' of target cube, computing data of point o' in said target cube corresponding to point o in said RGB color space having all colors corresponding to source graphic data comprises:

configured to define $\overline{NO}$ as distance between point N on said plane formed by four vertices e, f, g, and h of source cube and any point o in said source cube, $\overline{MO}$ as distance between point M on said plane formed b four vertices a, b, c and d of source cube and any point o in said source cube, $\overline{N'O'}$ as distance between point N' on said plane formed by four vertices e', f', g', and h' of target cube and point o' in said target cube corresponding to any point o, and $\overline{M'O'}$ as distance between point M' on said plane formed by four vertices a', b', c', and d' of target cube and point o' in said target cube corresponding to any point o; and based on an equation among point N' on said plane formed by four vertices e', f', g', and h' of target cube, point M' on said plane formed by four vertices a', b', c', and d' of target cube and point o' in said target cube corresponding to any point o, configured to compute data of point o' in said target cube corresponding to point o in said RGB color space having all colors corresponding to said source graphic data, wherein said equation is:

$$Ro' = R_{N'} + (R_{M'} - R_{N'}) * \frac{\overline{NO}}{\overline{NO} + \overline{MO}}$$

$$Go' = G_{N'} + (G_{M'} - G_{N'}) * \frac{\overline{NO}}{\overline{NO} + \overline{MO}}$$

$$\frac{\overline{MO}}{\overline{NO}} = \frac{\overline{M'O'}}{\overline{N'O'}} \qquad Bo' = B_{N'} + (B_{M'} - B_{N'}) * \frac{\overline{NO}}{\overline{NO} + \overline{MO}}.$$

* * * * *